United States Patent [19]

Asano

[11] 4,100,892

[45] Jul. 18, 1978

[54] CLOSED-LOOP MIXTURE CONTROL FOR AN INTERNAL COMBUSTION ENGINE OF A ROADWAY VEHICLE WITH MEANS FOR COMPENSATING FOR FUEL DEFICIENCY DURING VEHICLE START-UP PERIODS

[75] Inventor: Masaharu Asano, Yokohama, Japan

[73] Assignee: Nissan Motor Company, Limited, Yokohama, Japan

[21] Appl. No.: 685,255

[22] Filed: May 11, 1976

[30] Foreign Application Priority Data

May 12, 1975 [JP] Japan ..... 50-54614
Dec. 6, 1975 [JP] Japan ..... 50-63691

[51] Int. Cl.[2] ..... F02B 3/00

[52] U.S. Cl. ..... 123/32 EE; 123/119 EC; 123/179 G

[58] Field of Search ..... 123/32 EA, 32 EE, 119 EC, 123/179 G, 179 L; 74/861, 872, 873, 874; 60/285

[56] References Cited

U.S. PATENT DOCUMENTS

| | | | |
|---|---|---|---|
| 3,871,338 | 3/1975 | Schmidt et al. | 123/32 EE |
| 3,875,907 | 4/1975 | Wessel et al. | 123/32 EE |
| 3,896,913 | 7/1975 | Maruoka et al. | 60/285 |
| 3,939,738 | 2/1976 | Adey et al. | 74/861 |
| 3,990,411 | 11/1976 | Oberstadt et al. | 123/32 EA |

*Primary Examiner*—Samuel Feinberg
*Attorney, Agent, or Firm*—Lowe, King, Price & Markva

[57] ABSTRACT

A closed-loop mixture control system for an internal combustion engine of a roadway vehicle includes a vehicle start sensor and a voltage sensor to determine whether the fuel quantity at the instant the vehicle is started from at rest is below a predetermined value. When the signals from both sensors occur simultaneously the control voltages instantly varied to increase the fuel quantity.

2 Claims, 3 Drawing Figures

CLOSED-LOOP MIXTURE CONTROL FOR AN INTERNAL COMBUSTION ENGINE OF A ROADWAY VEHICLE WITH MEANS FOR COMPENSATING FOR FUEL DEFICIENCY DURING VEHICLE START-UP PERIODS

The present invention relates generally to mixture control systems for an internal combustion engine, and particularly to a closed-loop mixture control system for an internal combustion engine of a roadway vehicle wherein means are provided to compensate for any deficient quantity of fuel which is likely to result from a control oscillation under transient conditions of the loop when the vehicle is started from rest.

In a closed-loop mixture control system, the controller tends to keep influencing the fuel quantity in the same direction, although the reference point has been passed, due to the inherent transport delay time from the injection of air-fuel mixture to the generation of a control signal. This results in control oscillation which exists even under steady state conditions of the feedback loop. When the vehicle is started from rest, a large amplitude control oscillation results in the loop, and the engine is likely to be supplied with less fuel than is needed to start the vehicle.

The primary object of the invention is, therefore, to provide an improved closed-loop mixture control system having a vehicle start sensor for increasing the fuel quantity, a vehicle start sensor to sense the heavy load condition of the engine, and a voltage sensor to determine whether the fuel quantity at the moment the vehicle is started is below a predetermined value needed to meet the heavy load condition. The control voltage is derived when the two sensors generate signals simultaneously so that any fuel deficiency during the vehicle start-up period is compensated.

The invention will be further described by way of examples in the following description with reference to the accompanying drawings, in which.

Figure 1:
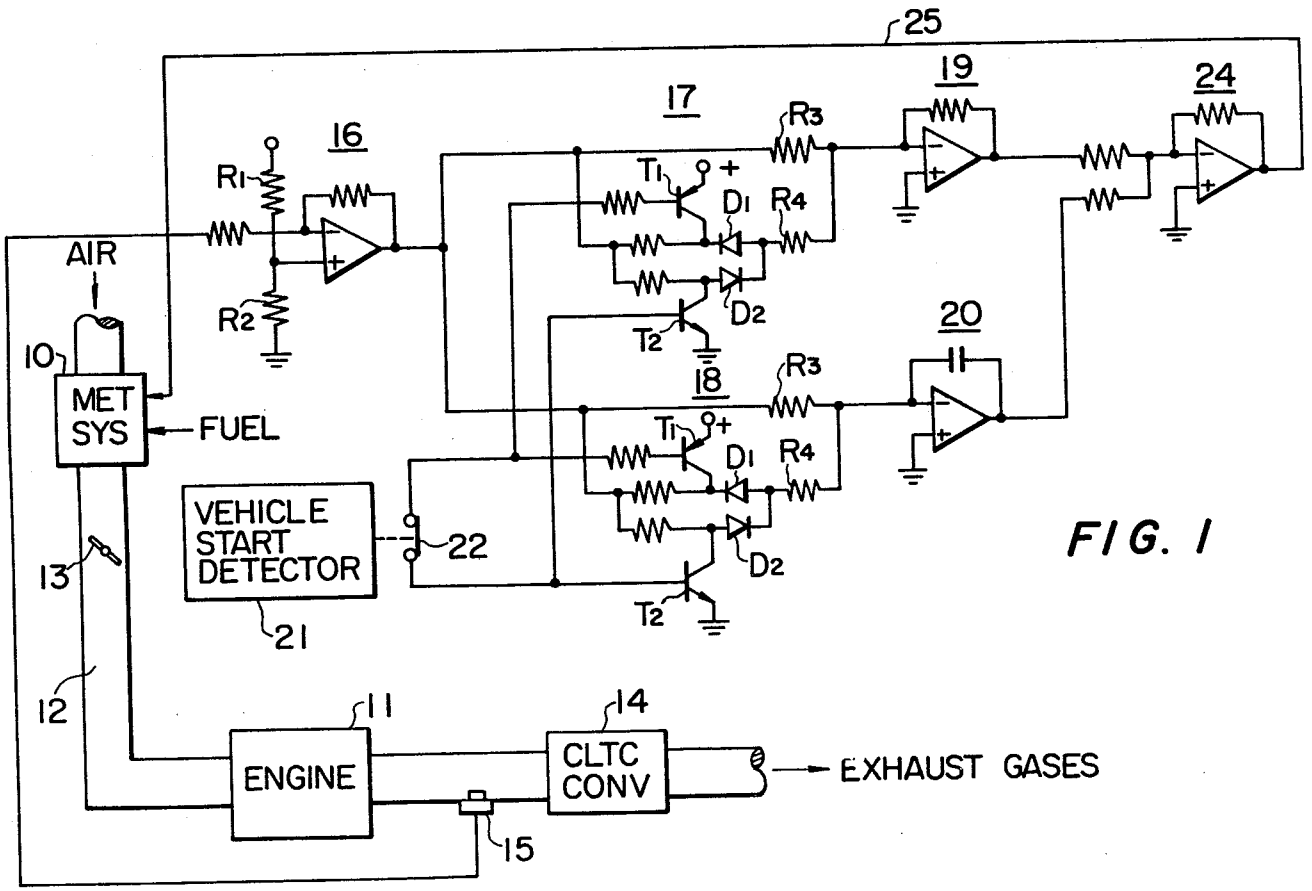
FIG. 1 is a circuit diagram of an embodiment of the closed-loop mixture control system of the invention.

Referring now to FIG. 1, there is illustrated an embodiment of the closed-loop mixture control system of the invention. A fuel metering system 10, such as conventional carburetion system, supplies air-fuel mixtures to the cylinders of an internal combustion engine 11 through air intake pipe 12 in which a throttle valve 13 is disposed in conventional manner. A catalytic converter 14, of a three-way catalyst type, for example, is provided at the exhaust side of engine 11 to convert the exhaust emissions to harmless water vapor and carbon dioxide. The three-way catalytic converter 14 operates at a maximum conversion efficiency to reduce the CO, HC and $NO_x$ components simultaneously when air-fuel mixture is controlled within a small range or window of airfuel ratios, which is usually called "stoichiometric air-fuel ratio". In order to maintain the mixture within the stoichiometric window, an exhaust composition sensor 15 is provided in the exhaust pipe at the upstream side of the catalytic converter 14. This sensor may be a commercially available zirconium dioxide oxygen sensor which extends into the passage of the exhaust gases to provide an output whose amplitude varies as a function of the air-fuel ratio with a steep transition of output voltage at the stoichiometric point. The signal from oxygen sensor 15 is fed to an inverting input of comparator, operational amplifier 16 for comparison with a predetermined d.c. voltage applied to a noninverting input of the amplifier from a voltage divider circuit $R_1$, $R_2$. The comparator 16 provides a shaped output signal of opposite polarities depending on whether the input signal is above or below the reference point: i.e. the output is respectively negative positive when the mixture is richer and leaner than stoichiometry.

The output from the comparator 16 is fed into a proportional control, operational amplifier 19 through a switched resistor network 17, on the one hand, and to an integral control operational amplifier 20 through a similar switched resistor network 18, on the other hand. Each of the switched resistor networks comprises first and second resistors $R_3$ and $R_4$, a pair of parallel oppositely polarized diodes $D_1$ and $D_2$ which are connected in turn to the resistor $R_4$, and a PNP transistor $T_1$ and an NPN transistor $T_2$. The emitter of transistor $T_1$ is connected to a positive source of d.c. voltage () and the collector is connected to the cathode terminal of diode $D_1$, while the transistor $T_2$ has its emitter connected to ground and its collector connected to the anode terminal of diode $D_2$. The base electrodes of transistors $T_1$, $T_2$ are interconnected by way of the normally closed contact switch 22 which is operated by a vehicle start detector 21.

In response to starting of the vehicle, vehicle start detector 21 drives normally closed contacts of switch 22 to an open state to cut off the circuit between the base electrodes of transistors $T_1$, $T_2$ of resistor networks 17 and 18. With the transistors $T_1$, $T_2$ being thus maintained nonconductive, diodes $D_1$ and $D_2$ of both resistor networks pass bipolar input signals applied thereto from amplifier 16 through resistor $R_4$; the signals from amplifier 16 always passes through resistor $R_3$ so that the signals from both resistors are respectively coupled from networks 17 and 18 to the inverting inputs of operational amplifiers 19 and 20. Therefore, a high output voltage appears at the output of both operational amplifiers 19, 20 when the vehicle is started and the fuel quantity is increased to enrich the air-fuel ratio.

After the vehicle has been started, detector 21 deactivates switch 22 so its contacts close, thus connecting the base electrodes of transistors $T_1$, $T_2$ of resistor network 17 to the base of transistors $T_1$, $T_2$ of resistor network 18. When this occurs, diodes $D_1$ and $D_2$ of both resistor networks 17 and 18 are rendered nonconductive and the input signals pass through resistor $R_3$ only, with the result that the average fuel quantity during the normal cruising drive is lower than that available during the vehicle start-up period. The outputs from both operational amplifiers 19 and 20 are fed into a summation circuit 24, having an output fed to the metering system 10 through lead 25 to vary the fuel quantity in accordance with the combined effects of proportional and integral control.

It is understood that the air-fuel ratio of the mixture supplied to the engine is controlled by the combined output from the summation amplifier 24 within the desired "stoichiometric window". However, due to the inherent transport delay time of the engine, the control system keeps influencing the fuel quantity in the same direction although the stoichiometric point has been passed, and control oscillation will result. When the vehicle is started from rest, air-fuel ratio is enriched to prevent the deficiency of fuel necessary for the vehicle start-up periods by lowering the resistances of the input circuits of both control amplifiers 19 and 20.

Figure 2:
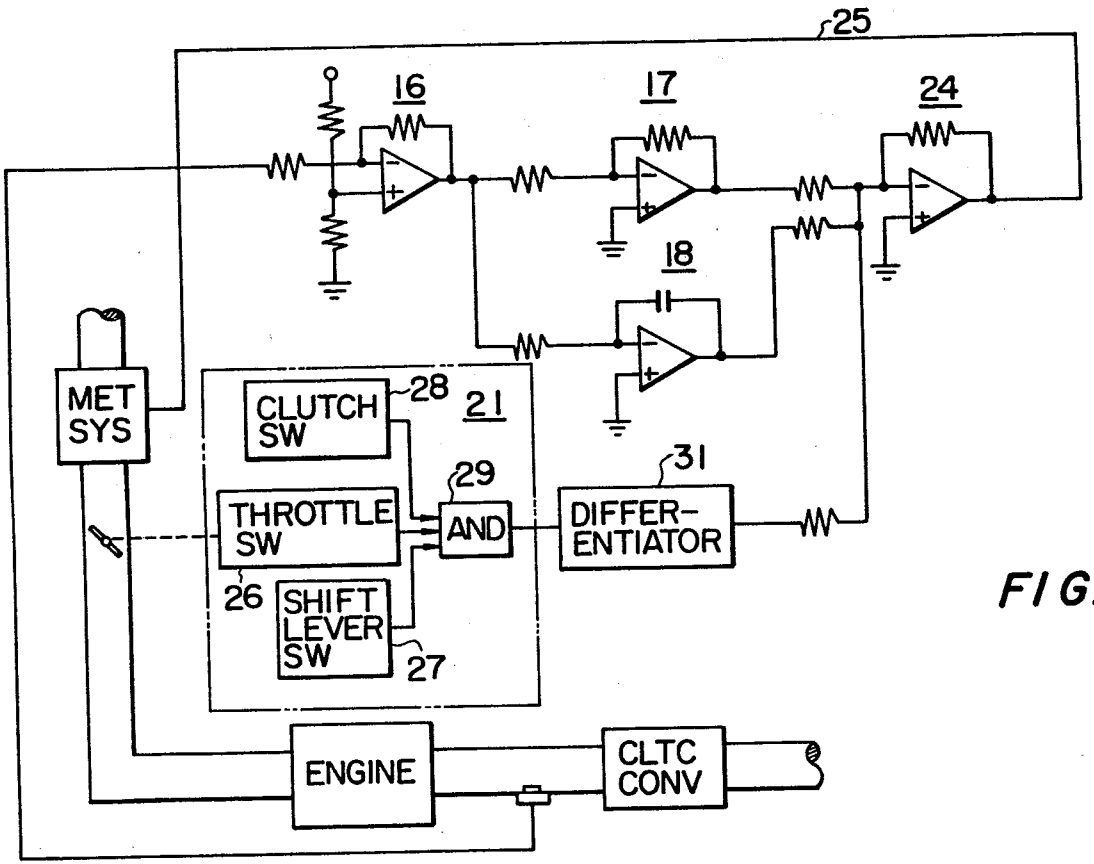
FIG. 2 is a preferred embodiment of the invention.

FIG. 2 illustrates a preferred embodiment of the invention. The vehicle start detector 21 comprises a throttle switch 26, a shift lever position switch 27 and a clutch switch 28 and an AND gate 29. When the vehicle is started, all of these switches are operated to apply input signals simultaneously to the AND gate 29 of which then applies a vehicle start signal to a differentiator 31 which generates a negative high voltage pulse at the leading edge of the input signal applied thereto. In the circuit of FIG. 2, the comparator 16 generates a negative polarity output when the sensed air-fuel ratio is lower than stoichiometry (rich) and a positive polarity output for leaner mixtures. The output from comparator 16 is amplified by proportional and integral control amplifiers 17 and 18, respectively, having output signal polarities opposite to the sign of the comparator 16 output. The summation circuit 24 provides summation of the two input signals from both amplifiers 17, 18 and generates an output whose polarity is opposite to the sign of the input signals applied thereto. Therefore, when the sensed mixture is leaner than stoichiometry, negative polarity signals will be applied to the summation circuit 24 so that the fuel quantity is increased to minimize the difference between the sensed and reference air-fuel ratios. Therefore, in this illustrative embodiment, negative polarity input to the summation circuit 24 serves to increase fuel quantity while positive polarity input signals will vary the fuel quantity in reverse direction.

It will be understood that when the vehicle is started, the negative high voltage pulse from the differentiator 31 serves to negatively bias the inverting input of the summation circuit 24 so that the fuel quantity is increased to a level required for vehicle start-up.

Figure 3:
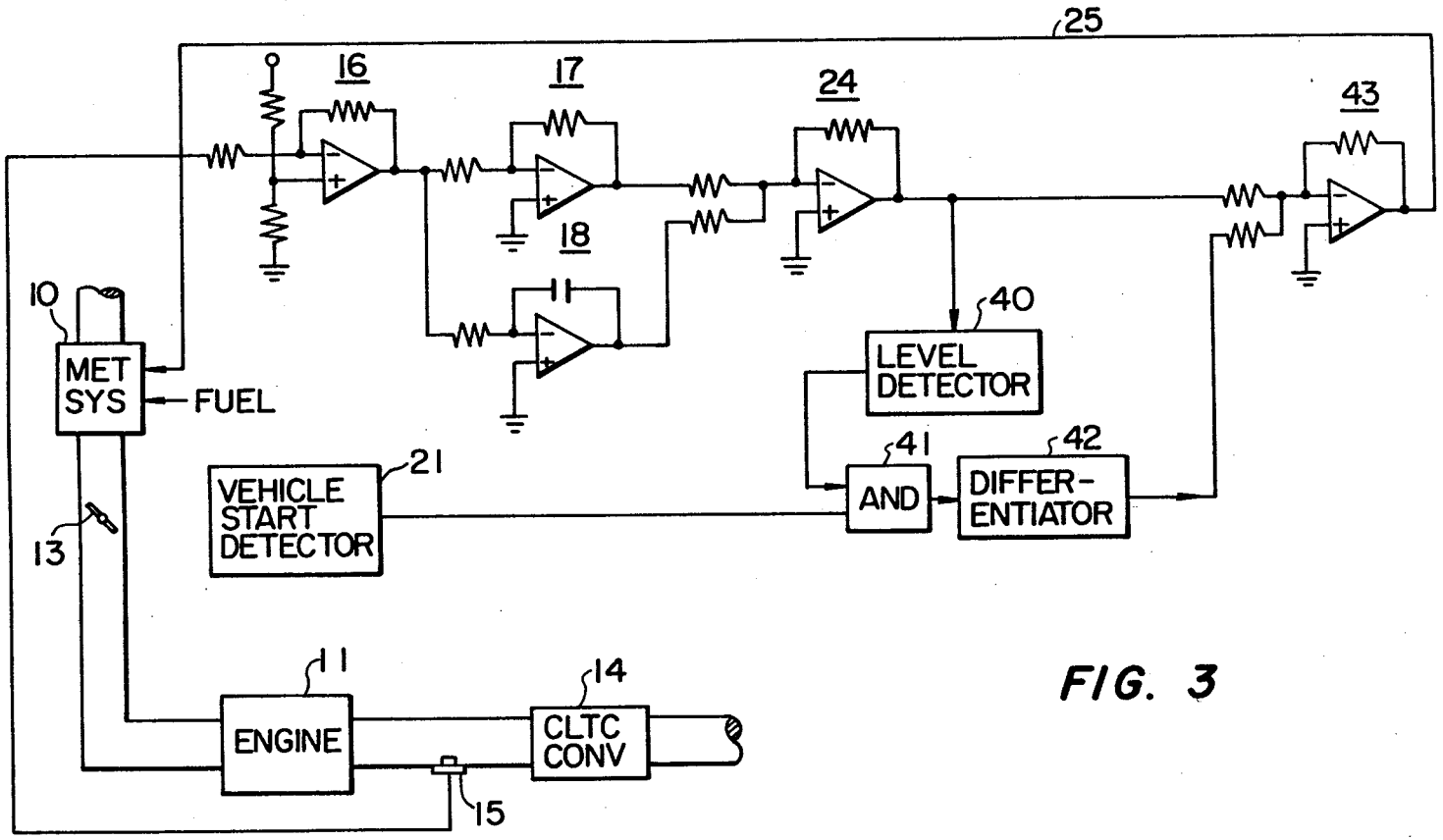
FIG. 3 is a modification of the circuit of FIG. 2.

A modification of the invention is shown in FIG. 3 which is generally similar to that shown in FIG. 2 with the exception that a level detector or comparator 40 is connected at the output of summation circuit 24 to detect when the air-fuel ratio falls below a predetermined value. The output signals from the vehicle start detector 21 and the level 40 detector 40 are fed into an AND gate 41 to provide a gated output when the control voltage sensed by the level detector 40 is below a predetermined voltage, while at the same time the vehicle is started up.

In this embodiment, a positive polarity output is delivered from summation circuit 24 when the sensed mixture is leaner than the reference point to increase the fuel quantity by the amount determined by the combined outputs from the proportional and integral control amplifiers 17 and 18. The output from the AND gate 41 is connected to a differentiator 42 which produces a positive high voltage pulse at the leading edge of the output from AND gate 41. Therefore, when the sensed air-fuel ratio is leaner than the reference point, a positive polarity high voltage pulse is applied to one input of a second summation circuit 43, having a second input connected to the output from the first summation amplifier 24. Summation circuit 43 then generates an output which is an amplification of the combined input signals with the polarity reversed so that during the vehicle start-up periods a negative high voltage control signal is delivered to the metering system 10 to increase its fuel supply.

What is claimed is:

1. A closed-loop mixture control system for an internal combustion engine of a roadway vehicle, said engine including means for supplying air and fuel in a controlled ratio thereto, said system comprising:

means for generating a first signal representing the concentration of an exhaust composition of the emissions from said engine;

means for comparing the first signal with a reference value to generate a second signal indicating the deviation of the air-fuel ration in said emissions from said reference value;

a vehicle start detector for generating an output only at the instant when the vehicle is being started from a rest, idle condition;

means for generating a compensating signal in response to the output from said vehicle start detector;

control amplifier means responsive to the second signal for generating a control signal which adjusts said air-fuel supply means in the direction of the deviation of said air-fuel ratio in said emissions from said reference value;

a summation circuit providing summation of the control signal and the compensating signal so that the air-fuel supply means is adjusted to supply an enriched mixture to said engine when the vehicle is started from a rest, idle condition;

said vehicle start detector including means for generating a step change DC signal in response to the detection of said vehicle being started from a rest, idle condition, and said compensating signal generating means comprising a differentiator for differentiating the leading edge of the step change DC signal for enriching said air-fuel ratio supplied by said air-fuel supply means.

2. In combination, apparatus for controlling the air-fuel ratio of a mixture supplied to an internal combustion engine of a roadway vehicle;

means for deriving a first signal indicative of the concentration of an exhaust composition of the emission from said engine;

a feedback loop responsive to the first signal for deriving a control signal that is supplied to the control apparatus so that during normal, running operation of the vehicle there is a tendency to maintain a predetermined air-fuel ratio of the emissions, said feedback loop having a tendency to oscillate so that there is a tendency for the first signal to cause less fuel to be supplied to the engine than is needed as the vehicle goes from an idle to a normal, running condition, the feedback loop including: a proportional-integral controller responsive to the first signal and including operational amplifier means;

means for overcoming the tendency for the first signal to cause less fuel to be supplied to the engine as the vehicle goes from an idle to a normal, running condition comprising:

a vehicle start detector for generating an output only substantially simultaneously with the vehicle being started in motion from an engine idle condition; and means responsive to the output of the start detector for modifying the feedback loop to cause the control apparatus to suddenly supply an enriched air-fuel mixture to the engine substantially simultaneously with the derivation of the start detector output, the means for modifying including means for deriving a short duration pulse in response to the derivation of the start detector output, and the operational amplifier means including means for linearly combining the pulse with a signal derived in response to the first signal.

* * * * *